US012668947B2

(12) United States Patent
Song et al.

(10) Patent No.: US 12,668,947 B2
(45) Date of Patent: Jun. 30, 2026

(54) CONSTRUCTION MACHINE AND MOTION METHOD USING SAME

(71) Applicant: HD HYUNDAI INFRACORE CO., LTD., Dong-gu (KR)

(72) Inventors: Seong Ho Song, Dong-gu (KR); Wook Hyun Yu, Dong-gu (KR)

(73) Assignee: HD HYUNDAI INFRACORE CO., LTD., Dong-Gu (KR)

( * ) Notice: Subject to any disclaimer, the term of this patent is extended or adjusted under 35 U.S.C. 154(b) by 0 days.

(21) Appl. No.: 18/844,544

(22) PCT Filed: Mar. 14, 2023

(86) PCT No.: PCT/KR2023/003405
§ 371 (c)(1),
(2) Date: Sep. 6, 2024

(87) PCT Pub. No.: WO2023/177185
PCT Pub. Date: Sep. 21, 2023

(65) Prior Publication Data

US 2025/0179770 A1 Jun. 5, 2025

(30) Foreign Application Priority Data

Mar. 14, 2022 (KR) ..... 10-2022-0031598

(51) Int. Cl.
*E02F 9/00* (2006.01)
*E02F 9/20* (2006.01)
*E02F 9/26* (2006.01)

(52) U.S. Cl.
CPC ..... *E02F 9/2025* (2013.01); *E02F 9/26* (2013.01)

(58) Field of Classification Search
CPC ..... E02F 9/2025; E02F 9/26; E02F 9/2062; E02F 9/2091; G06F 3/01
See application file for complete search history.

(56) References Cited

U.S. PATENT DOCUMENTS

2011/0102411 A1* 5/2011 Chang ..... H05B 41/282 345/212
2016/0259316 A1* 9/2016 Ohta ..... H04L 67/12
(Continued)

FOREIGN PATENT DOCUMENTS

EP 2196363 A1 6/2010
JP 2001220099 A 8/2001
(Continued)

OTHER PUBLICATIONS

International Search Report for related International Application No. PCT/KR2023/003405; action dated Sep. 21, 2023; (3 pages).
(Continued)

*Primary Examiner* — Russell Frejd
*Assistant Examiner* — Brittany Renee Peko
(74) *Attorney, Agent, or Firm* — K&L Gates LLP

(57) ABSTRACT

Disclosed is a construction machine, including: a communication device configured to receive or send data from/to an external device using wired and wireless communication technologies; a operation device configured to receive an instruction or data used for controlling an operation of a construction machine; an output device configured to output at least one among visual information, audible information, and tactile information related to an operation of the construction machine; and a processor configured to control at least one among the communication device, the operation device, and the output device, and to activate at least only some of components of each of the communication device and the output device in a stand-by mode.

11 Claims, 6 Drawing Sheets

(56) References Cited

U.S. PATENT DOCUMENTS

| | | | | |
|---|---|---|---|---|
| 2023/0036958 | A1* | 2/2023 | Tanishige | G09G 3/20 |
| 2024/0357503 | A1* | 10/2024 | Ito | H04W 88/06 |
| 2025/0043544 | A1* | 2/2025 | Mitani | B60L 50/61 |

FOREIGN PATENT DOCUMENTS

| | | | | | |
|---|---|---|---|---|---|
| JP | 2011055216 | A | | 3/2011 | |
| JP | 2016097853 | A | | 5/2016 | |
| KR | 20140080793 | A | * | 7/2014 | E02F 9/16 |
| KR | 20210142871 | A | | 11/2021 | |
| WO | WO-2016052693 | A1 | * | 4/2016 | G08B 25/10 |
| WO | 2021040038 | A1 | | 3/2021 | |
| WO | 2021090859 | A1 | | 5/2021 | |

OTHER PUBLICATIONS

Written Opinion for related International Application No. PCT/KR2023/003405; action dated Sep. 21, 2023; (4 pages).
Extended European Search Report for related European Application No. 23771064.5; action dated Nov. 6, 2025; (8 pages).

* cited by examiner

CONSTRUCTION MACHINE AND MOTION METHOD USING SAME

CROSS-REFERENCE TO RELATED APPLICATIONS

This application is the National Stage filing under 35 U.S.C. 371 of International Application No. PCT/KR2023/003405, filed Mar. 14, 2023, which claims the benefit of earlier filing date and right of priority to Korean Application No. 10-2022-0031598, filed on Mar. 14, 2022, the contents of which are all hereby incorporated by reference herein in their entirety.

FIELD

Various embodiments of the present disclosure relate to a construction machine capable of supporting a stand-by mode and an operation method using the same.

BACKGROUND

An equipment for civil engineering works in construction sites has been continuously improved and developed. Construction machines used in the construction sites are configured to be got on and manipulated by those skilled in the operation of the machine to perform the operations as the operator.

Therefore, construction quality may vary according to difference in the workmanship of the operators of the construction machines.

Recently, various sensors are installed in the construction machine to ease operational difficulty of the construction machines and the research and development for solving the safety management problems have been actively conducted.

For example, the research is being conducted such that an operator of the construction machines in which various sensors are installed can be provided with detection information of the sensors and the information combining the detection information in the form of visual or audible information.

The display devices for providing more visual information to the operator and methods for reducing the boot time of the display devices have been researched and developed.

SUMMARY

The construction machine having a display device supporting a stand-by mode and a method of operation using the same is needed.

The present disclosure aims to provide a construction machine capable of reducing a boot time of a display device by supporting a stand-by mode and an operation method using the same.

The technical problem to be achieved by the present disclosure is not limited to the above-mentioned technical problem, and other technical problems that are not mentioned will be clearly understood by ordinary-skilled persons in the art to which the present disclosure pertains from the following description.

One embodiment is a construction machine, including a communication device configured to receive or send data from/to an external device using wired or wireless communication technologies; an operation device configured to receive/send an instruction or data used for controlling an operation of a construction machine; an output device configured to output at least one among visual information, audible information, and tactile information related to an operation of the construction machine; and a processor configured to control at least one among the communication device, the operation device, and the output device, and to activate at least only some of components of each of the communication device and the output device in a stand-by mode.

According to various embodiments of the present disclosure, the processor may be configured to select whether to use the stand-by mode or set up a time period for which the stand-by mode is maintained by a setting of a user.

According to various embodiments of the present disclosure, the processor may include a main processor configured to control some of components of the output device; and an auxiliary processor configured to control a rest of the components of the output device, and during the stand-by mode, the main processor may be configured to activate the some of the components of the output device, and the auxiliary processor may be configured to deactivate the rest of the components of the output device.

According to various embodiments of the present disclosure, the processor may be configured to enter the stand-by mode or a sleep mode according to whether to use the stand-by mode when turning off an engine of the construction machine is detected.

According to various embodiments of the present disclosure, the processor may be configured to enter the stand-by mode when turning off an engine of the construction machine is detected and use of the stand-by mode is confirmed, and to enter to the sleep mode when turning off an engine of the construction machine is detected and use of the stand-by mode is not confirmed.

According to various embodiments of the present disclosure, the processor may be configured to activate some of components of each of the communication device and the output device and to deactivate a rest of components thereof when entered the stand-by mode, and to deactivate all the components of each of the communication device and the output device when entered the sleep mode.

According to various embodiments of the present disclosure, the communication device may include an Ethernet communication unit, a USB communication unit, a WiFi/BT communication unit, and a CAN communication unit, and the output device may include an LCD, a sound amplifier, an image input unit, an image output unit, and an audio output unit, and when entered the stand-by mode, the processor may be configured to activate the WiFi/BT communication unit and the CAN communication unit only among components of the communication device, and to deactivate the Ethernet communication unit and the USB communication unit, and to activate the image output unit and the audio output unit only among components of the output device, and to deactivate the sound amplifier and the image input unit.

According to various embodiments of the present disclosure, the processor may be configured to enter to the sleep mode when a time period for which the stand-by mode is maintained is exceeded, or a battery voltage is less than a preset voltage, in a state entered the stand-by mode.

According to various embodiments of the present disclosure, the processor may be configured to support a normal mode which activates all the components of each of the communication device and the output device, and in the stand-by mode, when use of at least one device among the communication device, the operation device or the output device by a user is detected, the processor may be configured to enter the normal mode.

Another embodiment is an operation method of a construction machine, including: detecting turning off an engine; confirming whether to use a stand-by mode when the turning off an engine is detected; entering to the stand-by mode when use of the stand-by mode is confirmed; confirming a time period for which the stand-by mode is maintained after entering to the stand-by mode; confirming a battery voltage after entering to the stand-by mode; and entering to a sleep mode when the time period for which the stand-by mode is maintained is exceeded or the battery voltage is less than a preset voltage after entering to the stand-by mode.

According to various embodiments of the present disclosure, the stand-by mode may be maintained when the battery voltage is higher than the preset voltage, and the time period for which the stand-by mode is maintained is not exceeded.

According to various embodiments of the present disclosure, the method may further include: activating only some of components of each of the communication device and the output device and deactivating a rest of the components thereof when entered to the stand-by mode; deactivating all the components of each of the communication device and the output device when entered to the sleep mode; activating all the components of each of the communication device and the output device when entered to a normal mode; and entering to the normal mode when use of at least one device among a communication device, an operation device or an output device by a user is detected in the stand-by mode or the sleep mode.

The embodiments of the present disclosure may improve convenience of a user by reducing the boot time of the display device.

Effects which may be obtained by the present disclosure are not limited to the aforementioned effects, and other technical effects not described above may be evidently understood by a person having ordinary skill in the art to which the present disclosure pertains from the following description.

DETAILED DESCRIPTION

Figure 1:
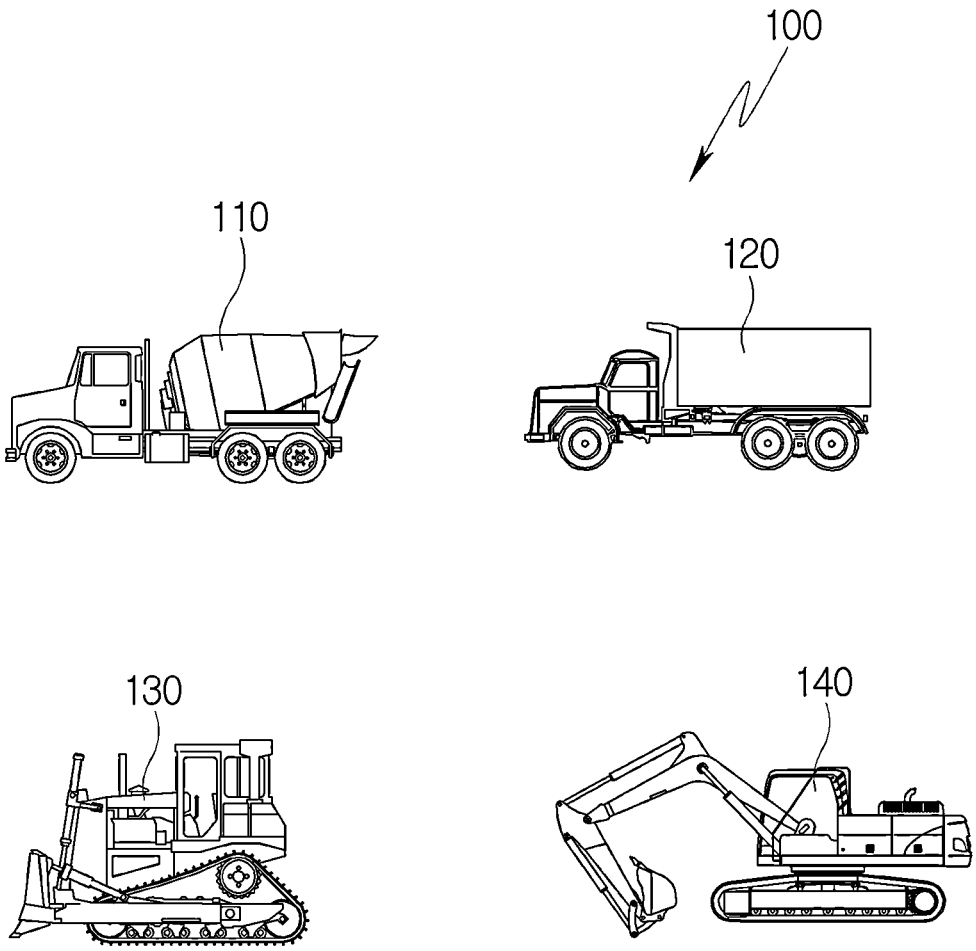
FIG. 1 is a view illustrating construction machines according to various embodiments of the present disclosure.

The merits and characteristics of the present disclosure and a system, a device, and a method for achieving the merits and characteristics will become more apparent from the embodiments described in detail in conjunction with the accompanying drawings. However, the present disclosure is not limited to the disclosed embodiments, but may be implemented in various different ways. The embodiments are provided to only complete the disclosure of the present disclosure and to allow those skilled in the art to understand the category of the present disclosure. The present disclosure is defined by the category of the claims. The same reference numerals will be used to refer to the same or similar elements throughout the drawings.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. As used herein, the term "and/or" includes, but is not limited to any and all combinations of one or more of the associated listed items.

The terms used in the present specification are for describing example embodiments and are not intended to limit the inventive concept. In the present specification, a singular form also includes a plural form unless particularly stated in the phrase. Components, steps, operations and/or elements that are referred to by terms "comprises" and/or "comprising" used in the inventive concept do not exclude presence or addition of one or more other components, steps, operations and/or elements.

Although the terms "first", "second", and the like are used for describing various components, these components are not confined by these terms. These terms are merely used for distinguishing one component from the other components.

Therefore, a first component to be mentioned below may be a second component in a technical concept of the present disclosure. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the related art and will not be interpreted in an idealized or overly formal sense unless expressly so defined herein.

A term "part" or "module" used in the embodiments may mean software components or hardware components such as a field programmable gate array (FPGA), an application specific integrated circuit (ASIC). The "part" or "module" performs certain functions. However, the "part" or "module" is not meant to be limited to software or hardware. The "part" or "module" may be configured to be placed in an addressable storage medium or to restore one or more processors. Thus, for one example, the "part" or "module" may include components such as software components, object-oriented software components, class components, and task components, and may include processes, functions, attributes, procedures, subroutines, segments of a program code, an drivers, firmware, microcode, circuits, data, databases, data structures, tables, arrays, and variables. Components and functions provided in the "part" or "module" may be combined with a smaller number of components and "parts" or "modules" or may be further divided into additional components and "parts" or "modules".

Methods or algorithm steps described relative to some embodiments of the present disclosure may be directly implemented by hardware and software modules that are executed by a processor or may be directly implemented by a combination thereof. The software module may be resident on a RAM, a flash memory, a ROM, an EPROM, an EEPROM, a resistor, a hard disk, a removable disk, a CD-ROM, or any other type of record medium known to those skilled in the art. An exemplary record medium is coupled to a processor and the processor can read information from the record medium and can record the information in a storage medium. In another way, the record medium may be integrally formed with the processor. The processor and the storage medium may reside in an application specific integrated circuit (ASIC). The ASIC may be resident within a user's terminal.

FIG. 1 is a view illustrating construction machines according to various embodiments of the present disclosure.

According to various embodiments of the present disclosure, a construction equipment 100 may mean a machine used in a civil engineering work site or a construction work site, and as illustrated in FIG. 1, may include a mixer truck 110, a dump truck 120, a dozer 130, and an excavator 140. However, these are merely examples, and the construction machine may include various machines such as a drilling machine, a crane, a wheel loader, a scraper. The construction machines may perform operations based on manipulation of a user or perform autonomous operations without the user. The autonomous operation may mean both an autonomous travel of the construction machine 100 without the manipulation of the user, and autonomous fulfillment of an operation which is to be performed by the construction machine 100.

According to an embodiment, the construction machine 100 may include a machine configured to perform an operation in a civil engineering work site or a construction work site with fossil fuel or electric energy provided as a power source.

For example, the excavator 140 using fossil fuel uses petroleum oil to rotate an engine, drives a hydraulic pump through power of the engine, and supplies a hydraulic oil discharged from the hydraulic pump to a hydraulic actuator of a hydraulic motor or a hydraulic cylinder etc., thereby operating rotation of a crawler or a tire, or each operational parts such as a boom, an arm, a bucket, and the like.

In addition, the excavator 140 using the electric energy as a power source is equipped with an electric motor configured to be rotated with the electric energy as a power, drives a hydraulic pump using the power of the motor, and supplies the hydraulic oil discharged from a hydraulic pump to a hydraulic actuator such as a hydraulic motor or a hydraulic cylinder, thereby rotating a crawler or a tire, or each operational part such as a boom, an arm, and a bucket.

When the user has a smart key and nears to the construction machine 100, a vehicle door locking device in a locked state may be unlocked, and when the user has a smart key and gets on the construction machine 100, the user may start an engine of the construction machine 100.

Figure 2:
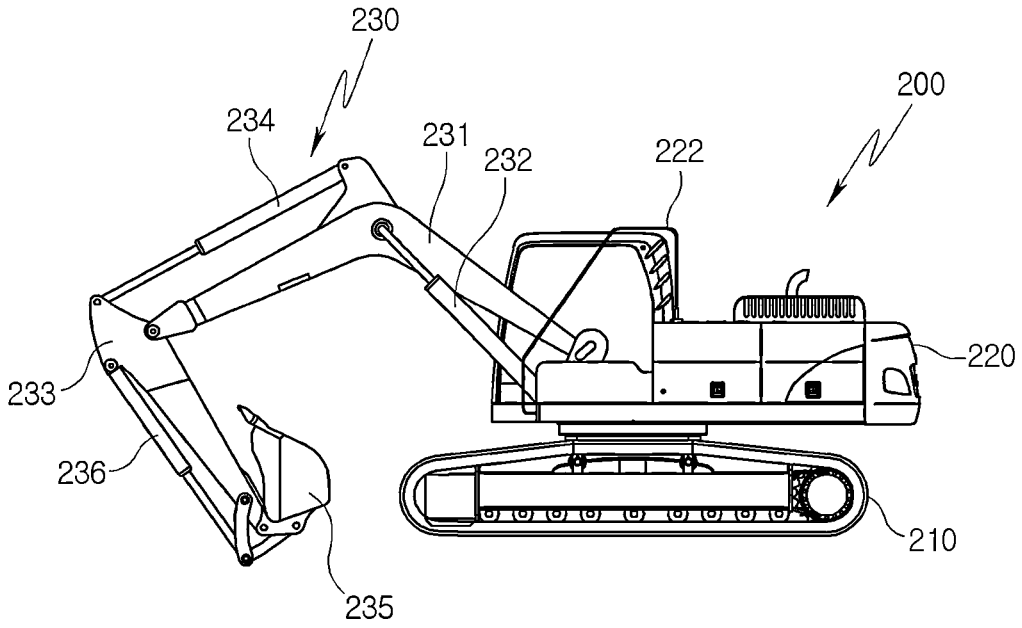
FIG. 2 is a view for describing an excavator according to various embodiments of the present disclosure.

FIG. 2 is a view for describing an excavator according to various embodiments of the present disclosure. Hereinafter, the excavator among the construction machines illustrated in FIG. 1 is taken as an example, however, the construction machine is not limited to the excavator.

Referring to FIG. 2, the excavator 200 may include a lower body 210, an upper body 220 mounted on the lower body 210 and rotating at 360 degrees, and a front work device 230 coupled to a front side of the upper body 220. However, this configuration is merely an example, and the embodiment of the present disclosure is not limited thereto. For example, one or more other components except the above-mentioned components of the excavator 200 (e.g., a plate coupled to a rear of the lower body 210) may be added.

According to various embodiments, the upper body 220 may include an interior space (not illustrated) in which a cab 222 in which a driver rides and operates is positioned and on which a power generating device (e.g., an engine) is mounted. The cab 222 may be provided in a portion close to a work area. The work area is a space in which the excavator 200 works and is located in the front of the excavator 200. For example, in consideration of a position where the driver on board performs an operation with a secured field of view and the front work device 230 is mounted, the cab 222 may be located at a position which is close to the work area as shown in FIG. 2 and is deflected to one side in the upper body 220.

According to various embodiments, the front work device 230 is mounted on the top of the upper body 220 and may be a device for performing operation such as digging land or transporting an object having a large load. According to one embodiment, the front work device 230 may include a boom 231 rotatably coupled to the upper body 220, a boom cylinder 232 configured to rotate the boom 231, an arm 233 rotatably coupled to the front end of the boom 231, an arm cylinder 234 configured to rotate the arm 233, a bucket 235 rotatably coupled to the front end of the arm 233, and a bucket cylinder 236 configured to rotate the bucket 235. During the operation of the excavator 200, one end of the boom 231, one end of the arm 233, and one end of the bucket 235 may individually rotate to maximize the reachable area of the bucket 235. Since the above-described front work device 230 is known from many documents, a detailed description thereof will be omitted.

According to various embodiments, the lower body 210 may be coupled to the bottom of the upper body 220. The lower body 210 may include a traveling body formed in a wheel type using wheels or a crawler type using caterpillars. The traveling body may implement forward, backward, left, and right movements of the excavator 200 by using power generated by the power generating device as a driving power. According to one embodiment, the lower body 210 and the upper body 220 may be rotatably coupled by a center joint.

Figure 3:
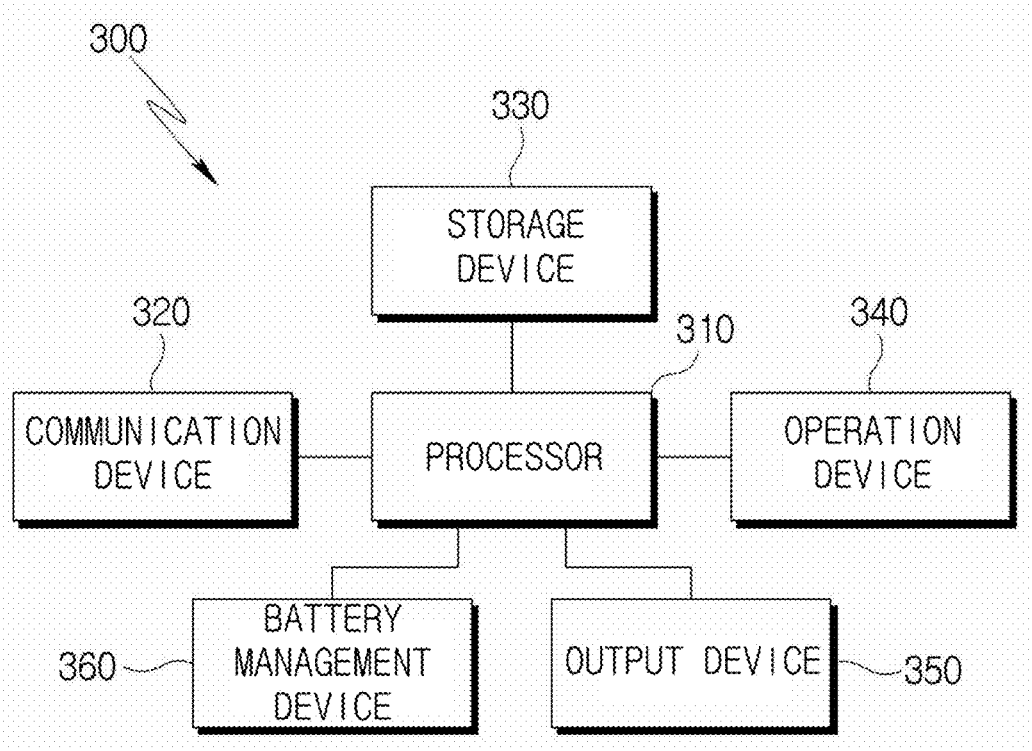
FIG. 3 is a diagram conceptually illustrating a construction machine according to various embodiments of the present disclosure.

FIG. 3 is a diagram conceptually illustrating an excavator according to various embodiments of the present disclosure.

Hereinafter, FIG. 3 may be described based on an excavator which is taken as an example of the construction machine 300, however, the present disclosure is not limited to the excavator.

Referring to FIG. 3, the construction machine, for example, the excavator 300 may include a processor 310, a communication device 320, a storage device 330, a operation device 340, an output device 350, and a battery management device 360. However, this is merely an example, and embodiments of the present disclosure are not limited thereto. For example, at least one of the above-described components of the construction machine 300 may be omitted or one or more other components (e.g., an input device or the like) may be added to the construction machine 300.

According to various embodiments, the communication device 320 may transmit/receive data to/from an external device using wireless communication technology. The external device may include control centers (not illustrated) and other construction machinery (110 to 130). For example, the communication device 320 may receive a work instruction from an external device and transmit work-related information (e.g., work result) to the external device. In this case, the communication technology used by the communication device 320 may include GSM (Global System for Mobile communication), CDMA (Code Division Multi Access), LTE (Long Term Evolution), 5G, WLAN (Wireless LAN), Wi-Fi (Wireless-Fidelity), Bluetooth, RFID (Radio Frequency Identification), Infrared Data Association (IrDA), ZigBee, NFC (Near Field Communication), Ethernet communication, Universal Serial Bus communication (USB), CAN (Controller Area Network) communication, and the like.

For example, the communication device 320 may include at least one or more among a CSM communication unit, a CDMA communication unit, an LTE communication unit, a 5G communication unit, a WLAN communication unit, a WiFi communication unit, a Bluetooth communication unit, an RFID communication unit, an infrared communication unit, a ZigBee communication unit, an NFC communication unit, an Ethernet communication unit, a USB communication unit, and a CAN communication unit.

According to various embodiments, the storage device 330 may store various data used by at least one component of the excavator 300 (e.g., the processor 310, the communication device 320, the operation device 340, the output device 350, or the battery management device 360). According to one embodiment, the storage device 330 may store specifications of the construction machine 300 (e.g., model name, serial number, basic specifications), map data, and the like. For example, the storage device 330 may include at least one of a non-volatile memory device and a volatile memory device. In addition, the storage device 330 may include a main memory and an auxiliary memory, and store data divided according to importance or functions of the data in the main memory or the auxiliary memory.

According to various embodiments, the sensor device (not illustrated) may collect information related to at least one of a state of the construction machine 300, a work area of the construction machine 300, or a surrounding obstacle of the construction machine 300 using various sensors. For example, at least one of an angle sensor, an inertial sensor, or a rotation sensor for collecting information related to the state of the construction machine 300 may be used as a configuration of the sensor device, and at least one of an electromagnetic wave sensor, a camera sensor, a radar, a LiDAR, and an ultrasonic sensor for collecting information related to a work area and a surrounding obstacle of the construction machine 300 may be used as a component of the sensor device. However, this is merely an example, and embodiments of the present disclosure are not limited thereto. For example, various types of sensors capable of collecting information related to the state of the construction machine 300, the work area of the construction machine 300, or a surrounding obstacle of the construction machine 300 may be used as the component of the sensor device.

According to various embodiments, the operation device 340 may control operations of a construction machine, for example, the excavator 300.

According to various embodiments, the operation device 340 may receive a work instruction or data used for controlling operations of the excavator 300. The operation device 340 may include a control lever for controlling at least some (e.g., a boom 231, an arm 233, and a bucket 235) of the front work device 230, a handle for controlling steering of the lower body 210, and a shifting lever for controlling a moving speed or traveling of the excavator 300 in forward and rearward directions. According to one embodiment, the operation device 340 may be provided at the cab 222 which has been described referring to FIG. 2.

According to various embodiments, the output device 350 may generate an output related to operations of the excavator 300. According to one embodiment, the output device 350 may include a display configured to output visual information, an audio data output device configured to output audible information, and a haptic module configured to output tactile information. For example, the display may include an LCD display, an LED display, an OLED display, a MEMS display, or an electronic paper etc. In addition, the audio data output device may include a speaker, an earphone, an earset, or a headset, which is included in the excavator 300, or connected to the excavator 300 through the wired/wireless communication.

For example, the output device 350 may include at least one or more among an LCD, a sound amplifier, an image input unit, an image output unit, and an audio output unit.

According to various embodiments, the processor 310 may be configured to control overall operations of the excavator 300. According to one embodiment, the processor 310 may execute software (e.g., a program) stored in the storage device 330 to control at least one of components connected to the processor 310 (e.g., the communication device 320, the storage device 330, the operation device 340, the output device 350, or the battery management device 360) and perform various data processing or operations. For example, as at least a part of data processing or operation, the processor 310 may store instructions or data received from other components in the storage device 330, process the instructions or data stored in the storage device 330, and store result data in the storage device 330. The processor 310 may be composed of a main processor and an auxiliary processor capable of being operated independently of or together with the main processor. According to one embodiment, the processor 310 may perform CAN (Controller Area Network) communication with the aforementioned component (e.g., the communication device 320, the storage device 330, the operation device 340, the output device 350, or the battery management device 360), but the present disclosure is not limited thereto.

For example, the processor 310 may include at least one or more among a Micro Controller Unit (MCU), a Central Processing Unit (CPU), a Micro Processing Unit (MPU), and a micro-computer (Micom).

According to various embodiments, the battery management device 360 may be a device configured to control a battery which supplies electric energy to an electronic equipment of the construction machine to operate in an optimized operational environment. Here, the battery management device 360 may measure a current, a voltage, and a temperature etc. of the battery through a sensor and may control a charging state, a discharging state, and a residual amount of the battery.

The construction machine 300 configured as above may provide a normal mode, a stand-by mode, and a sleep mode.

The normal mode may be a mode which can operate all the devices or functions controllable by the processor 310. Here, the normal mode may be a mode which is performed during when the engine of the construction machine is turned on (engine ON).

The stand-by mode may be a mode which can operate only some of the devices or functions controllable by the processor 310. Here, devices or functions controllable by the processor 310 and devices or functions of which operations are stopped can be divided in the stand-by mode. In addition, the stand-by mode may be a mode which can be operated when a battery voltage is equal to or more than a preset voltage during a preset time period after an engine is turned off (engine OFF) (e.g., a time period for which the stand-by mode is maintained).

The sleep mode may be a mode in which operations of all the devices or functions controllable by the processor 310 are stopped. Here, the sleep mode may be operated when the time period for which the stand-by mode is maintained is exceeded after an engine is turned off (engine off), or when the battery voltage is less than a preset voltage.

The conventional construction machine having an Android operating system operates from the sleep mode to the normal mode when an engine of the construction machine is turned on by the operator after a booting (e.g., a cold booting). In this case, all the devices or functions of the construction machine are booted up from the beginning, therefore there is a shortcoming that the boot time is long. Therefore, the present disclosure manages the stand-by mode additionally, thereby reducing the boot time.

According to various embodiments, the user who uses the construction machine 300 may separately set up whether to use the stand-by mode or a time period for which the stand-by mode is maintained considering characteristics of a work etc. In this instance, the processor 310 may check whether to use the set stand-by mode when turning off an engine (engine off) is detected. In addition, the processor 310 may monitor the voltage of the battery by communicating with the battery management device 360.

Meanwhile, when it is set not to use the stand-by mode, the processor 310 may enable the sleep mode to operate when the engine is turned off. That is, when an engine is turned off in a state in which it is set not to use the stand-by mode, the processor 310 may operate the sleep mode to stop operations of all the devices or functions controllable by the processor 310.

Meanwhile, when it is set to use the stand-by mode, the processor 310 may enable the stand-by mode to operate when turning off an engine is detected. At this instance, the stand-by mode may operate when the battery voltage is equal to or more than a preset voltage during a preset time period for which the stand-by mode is maintained, and may only operate some of devices or functions controllable by the processor 310.

In addition, when the time period for which the stand-by mode is maintained is exceeded, or the battery voltage is lowered to be less than the preset voltage during an operation of the stand-by mode, the processor 310 may stop the stand-by mode and operate the sleep mode.

When the sleep mode is performed, the processor 310 may stop (turn OFF) operations of all the devices or functions controllable by the processor 310.

At last, when it is set not to use the stand-by mode, and an engine is turned off, the processor 310 may enter the sleep mode, and may turn off all devices or functions controllable by the processor 310. In addition, when it is set to use the stand-by mode, and an engine is turned off, the processor 310 may enter the stand-by mode. In addition, when the battery voltage is equal to or more than the preset voltage during the time period for which the stand-by mode is maintained, the processor may turn on only some of the devices or functions controllable by the processor 310, and turn off the rest thereof.

Meanwhile, when the time period for which the stand-by mode is maintained is exceeded, or the battery voltage is lowered to be less than the preset voltage during the operation of the stand-by mode, the processor 310 may enter the sleep mode and turn off all the devices or functions controllable by the processor 310.

In addition, according to one embodiment, when use of a device by the user (e.g., getting closer to the machine using a smart key etc. or opening a door of the machine through a signal of a door lock) is detected during fulfillment of the stand-by mode, the processor 110 may enter the normal mode and turn on all the devices or functions controllable by the processor 310.

The processor 110 may enter the normal mode when turning on an engine is detected during fulfillment of any mode among the stand-by mode and the sleep mode (engine is turned on), and turn on all the devices or functions controllable by the processor 310.

A time period taken for turning on only some of the devices or functions which are in an OFF-operational state (a time period taken for entering the normal mode from the stand-by mode) may be shorter than a time period taken for turning on all the devices or functions which are in an OFF-operational state.

Therefore, the construction machine 300 which supports the stand-by mode according to various embodiments of the present disclosure may enter the normal mode more quickly, that is, may turn on all the devices or functions more quickly than the construction machine which does not support the stand-by mode, when the battery voltage is equal to or more than the preset voltage after an engine is turned off, and an engine is resumed during the time period for which the stand-by mode is maintained.

Figure 4:
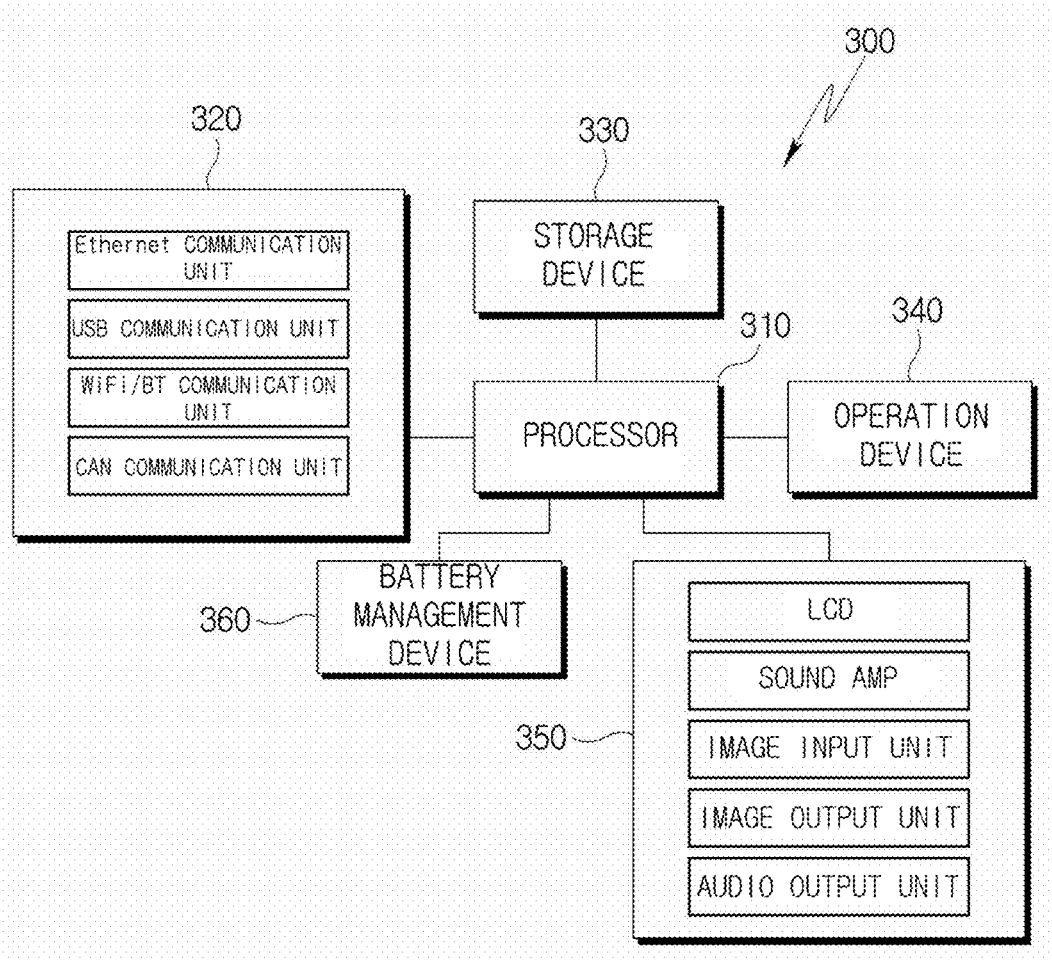
FIGS. 4 and 5 are diagrams for describing operations of a construction machine according to various embodiments of the present disclosure.
Figure 5:
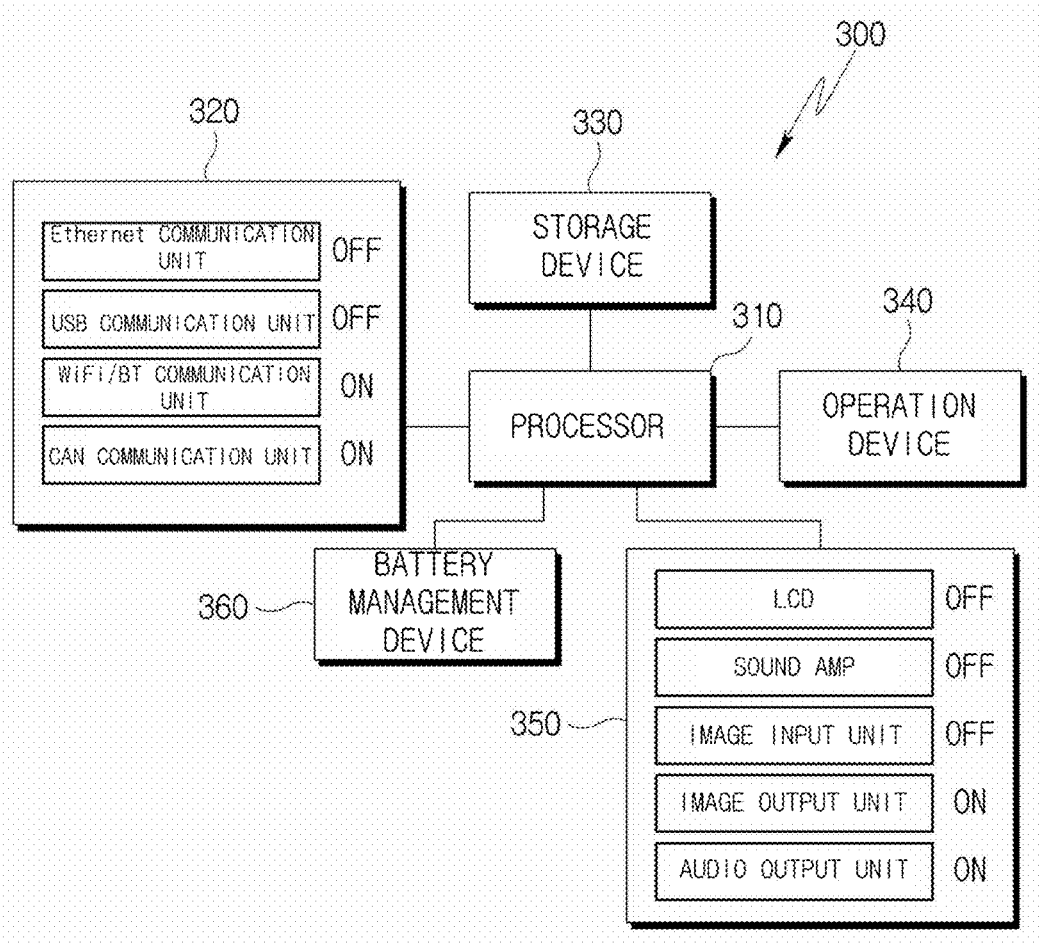

FIGS. 4 and 5 are diagrams for describing operations of the construction machine according to various embodiments of the present disclosure.

In particular, FIG. 4 shows the construction machine according to various embodiments of the present disclosure, and merely illustrates an example in which the communication device 320 includes the Ethernet communication unit, the USB communication unit, the WiFi/BT communication unit, and the CAN communication unit, and the output device 350 includes the LCD, the sound amplifier, the image input unit, the image output unit, and the audio output unit, but does not limit the communication device 320 thereto.

As illustrated in FIG. 4, when the construction machine 300 includes the communication device 320 including the Ethernet communication unit, the USB communication unit, the WiFi/BT communication unit, and the CAN communication unit, and the output device 350 including the LCD, the sound amplifier, the image input unit, the image output unit, and the audio output unit, the processor 310 may turn on all the components provided in the communication device 320 and the output device 350 in the normal mode, and turn off all the components provided in the communication device 320 and the output device 350 in the sleep mode.

FIG. 5 may illustrate some components which are turned on among components provided in the communication device 320 and the output device 350 when the construction machine 300 illustrated in FIG. 4 enters the stand-by mode.

When entering the stand-by mode, the processor 310 may turn on only the WiFi/BT communication unit and the CAN communication unit among the Ethernet communication unit, the USB communication unit, the WiFi/BT communication unit, and the CAN communication unit, and turn off the rest thereof (the Ethernet communication unit, the USB communication unit).

In addition, during the stand-by mode, the processor 310 may turn on only the image output unit and the audio output unit among the LCD, the sound amplifier, the image input unit, the image output unit, and the audio output unit, and turn off the rest thereof (the LCD, the image input unit, and the sound amplifier).

FIG. 5 illustrates the ON-operational state and the OFF-operational state of the components which may be provided in each of the communication device 320 and the output device 350 in the stand-by mode separately, however, as the same as the description below, the configuration of FIG. 5 may be applied to a case in which each of the processor 310 and the storage device 330 is divided into a main component and an auxiliary component.

During the stand-by mode, the main processor among the main processor (e.g., a main CPU, a Micom, an MCU) and the auxiliary processor which may be included in the processor 310 may maintain the ON-operational state (active state) and the auxiliary processor may be switched to the OFF-operational state (inactive state). For example, the auxiliary processor may turn off some component which has a long boot time (e.g., the LCD, etc.) among the components of the output device 350, and the main processor may turn on some component which has a relatively short boot time among the components of the output device 350. Some component which has a relatively short boot time among the components of the output device 350 may be, for example, a component which substantially controls the LCD and the like. As such, the main processor may maintain the ON-operational state in the stand-by mode, therefore, some component controlled by the main processor among the components of the output device 350 may be booted up quickly. Therefore, the user may recognize that some component controlled by the main processor can be turned on within a quick time point in the stand-by mode. When the storage device 330 includes the main memory and the auxiliary memory, in the stand-by mode, the processor 310 may turn on the main memory only, and may turn off the auxiliary memory.

In addition, the construction machine 300 supporting the stand-by mode according to various embodiments of the present disclosure may allow the user or the operator to set up components to be turned on and components to be turned off in the stand-by mode among the components provided in each of the processor 310, the communication device 320, the storage device 330, and the output device 350.

In FIGS. 4 and 5, it is illustrated and described that the communication device 320 may include the Ethernet communication unit, the USB communication unit, the WiFi/BT communication unit, and the CAN communication unit, and the output device 350 may include the LCD, the sound amplifier, the image input unit, the image output unit, and the audio output unit. However, the communication device 320 may perform an Ethernet communication function, a USB communication function, a WiFi/BT communication function, and a CAN communication function, and the output device 350 may perform a screen display function with an LCD, a sound amplification function with a sound amplifier, an image input function, an image output function, and an audio output function.

Therefore, the processor 310 may activate a WiFi/BT function and a CAN function only among all the functions of the communication device 320, and deactivate the rest communication functions (the Ethernet communication function and the USB communication function) in the stand-by mode.

In addition, the processor 310 may activate the image output function and the audio output function only among all the functions of the output device 350, and deactivate the screen display function, the sound amplification function, and the image input function, in the stand-by mode.

In the end, the construction machine 300 supporting the stand-by mode according to various embodiments of the present disclosure supports the normal mode and the sleep mode configured to turn on or turn off all the components or functions of internal devices of the construction machine 300, and the stand-by mode configured to turn on some components or functions only of the internal devices of the internal devices of the construction machine 300, thereby reducing a time period taken for entering the normal mode when an engine is turned off and then, is resumed within a time period for which the stand-by mode is maintained.

Figure 6:
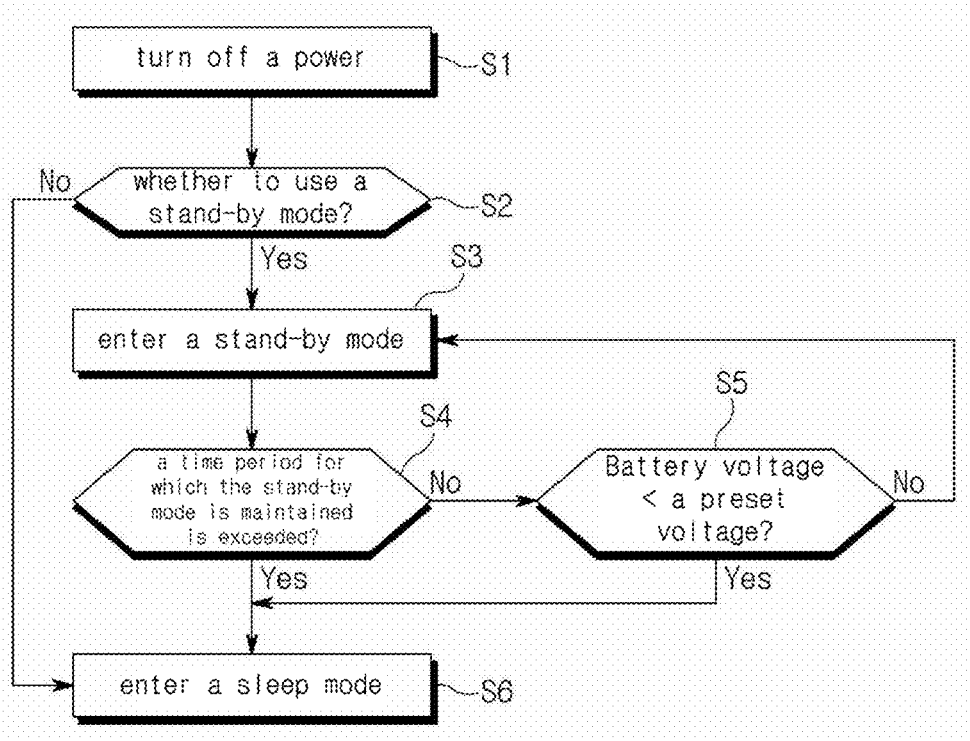
FIG. 6 is a flowchart for describing an operation method using a construction machine according to various embodiments of the present disclosure.

FIG. 6 is a flowchart for describing an operation method using the construction machine according to various embodiments of the present disclosure.

Referring to FIG. 6, the operation method using the construction machine according to various embodiments of the present disclosure may include detecting turning off an engine (S1); confirming whether to use a stand-by mode (S2); entering a stand-by mode (S3); confirming a time period for which the stand-by mode is maintained is exceeded (S4); confirming a battery voltage (S5); and entering a sleep mode (S6).

The detecting turning off an engine (S1) may include detecting turning off an engine of the construction machine by the processor 310.

The confirming whether to use a stand-by mode (S2) may be an operation for confirming whether to use the stand-by mode.

When whether to use the stand-by mode is confirmed in the confirming whether to use a stand-by mode (S2) (Yes), the entering a stand-by mode (S3) may be performed, and when whether to use the stand-by mode is not confirmed in the confirming whether to use a stand-by mode (S2) (No), the entering a sleep mode (S6) may be performed.

The entering a stand-by mode (S3) may include activating some components or functions of the devices controllable by the processor 310, and deactivating the rest thereof.

The confirming a time period for which the stand-by mode is maintained is exceeded (S4) may include confirming whether a time period for which the stand-by mode is maintained is exceeded after entering the stand-by mode.

In the confirming a time period for which the stand-by mode is maintained is exceeded (S4), when the time period for which the stand-by mode is maintained is exceeded (Yes), the entering a sleep mode (S6) may be performed.

On the other hand, in the confirming a time period for which the stand-by mode is maintained is exceeded (S4), when the time period for which the stand-by mode is maintained is not exceeded (No), the confirming a battery voltage (S5) may be performed.

The confirming a battery voltage (S5) may include comparing the battery voltage and the preset voltage to each other.

In the confirming a battery voltage (S5), when it is confirmed that the battery voltage is higher than the preset voltage (No), the entering a stand-by mode (S3) may be performed.

On the other hand, in the confirming a battery voltage (S5), when it is confirmed that the battery voltage is lower than the preset voltage (Yes), the entering a sleep mode (S6) may be performed.

That is, the entering a stand-by mode (S3); the confirming a time period for which the stand-by mode is maintained is exceeded (S4); and the confirming a battery voltage (S5) may be repeatedly performed, and when the battery voltage is higher than the preset voltage after an engine is turned off, the stand-by mode may be maintained for the time period for which the stand-by mode is maintained.

The entering a sleep mode (S6) may include turning off all the components or functions included in the devices controllable by the processor 310.

In the end, by activating only some of the components included in the devices controllable by the processor for the time period for which the stand-by mode is maintained and deactivating the rest thereof, the construction machine 300 supporting the stand-by mode according to various embodiments of the present disclosure may reduce a time taken for entering the normal mode after an engine is turned off, and then, is resumed within the time period for which the stand-by mode is maintained, and minimize power of the battery consumed in the stand-by mode.

Although the present disclosure has been described with reference to the embodiments illustrated in the drawings, this is merely exemplary. It will be understood by those skilled in the art that various modifications and equivalent embodiments thereto may be implemented. Accordingly, the true technical protection scope of the present disclosure should be determined by the following claims.

The invention claimed is:

1. A construction machine, comprising:

a communication device configured to receive or send data from/to an external device using wired or wireless communication technologies;

an operation device configured to receive an instruction or data used for controlling an operation of a construction machine;

an output device configured to output at least one among visual information, audible information, and tactile information related to an operation of the construction machine; and a processor configured to control at least one among the communication device, the operation device, and the output device, and to activate at least only some of components of each of the communication device and the output device in a stand-by mode, wherein the processor comprises a main processor configured to control some of components of the output device and an auxiliary processor configured to control a rest of the components of the output device, and wherein, during the stand-by mode, the main processor is configured to activate the some of the components of the output device and the auxiliary processor is configured to deactivate the rest of the components of the output device.

2. The construction machine of claim 1, wherein the processor is configured to select whether to use the stand-by mode or set up a time period for which the stand-by mode is maintained by a setting of a user.

3. The construction machine of claim 1, wherein, when turning off an engine of the construction machine is detected, the processor is configured to enter the stand-by mode or a sleep mode according to whether to use the stand-by mode.

4. The construction machine of claim 3, wherein the processor is configured to enter the stand-by mode when turning off an engine of the construction machine is detected and use of the stand-by mode is confirmed, and to enter to the sleep mode when turning off an engine of the construction machine is detected and use of the stand-by mode is not confirmed.

5. The construction machine of claim 4, wherein the processor is configured to activate some of components of each of the communication device and the output device and to deactivate a rest of components thereof when entered the stand-by mode, and to deactivate all the components of each of the communication device and the output device when entered the sleep mode.

6. The construction machine of claim 5, wherein the communication device comprises an Ethernet communication unit, a USB communication unit, a WiFi/BT communication unit, and a CAN communication unit, wherein the output device comprises an LCD, a sound amplifier, an image input unit, an image output unit, and an audio output unit, and wherein when entered the stand-by mode, the processor is configured to activate the WiFi/BT communication unit and the CAN communication unit only among components of the communication device, and to deactivate the Ethernet communication unit and the USB communication unit, and to activate the image output unit and the audio output unit only among components of the output device, and to deactivate the sound amplifier and the image input unit.

7. The construction machine of claim 4, wherein the processor is configured to enter to the sleep mode when a time period for which the stand-by mode is maintained is exceeded, or a battery voltage is less than a preset voltage, in a state entered the stand-by mode.

8. The construction machine of claim 1, wherein the processor is configured to support a normal mode which activates all the components of each of the communication device and the output device, and wherein in the stand-by mode, when use of at least one device among the communication device, the operation device or the output device by a user is detected, the processor is configured to enter the normal mode.

9. An operation method of a construction machine, comprising:

detecting turning off an engine;

confirming whether to use a stand-by mode when the turning off an engine is detected;

entering to the stand-by mode when use of the stand-by mode is confirmed;

confirming a time period for which the stand-by mode is maintained after entering to the stand-by mode;

confirming a battery voltage after entering to the stand-by mode;

entering to a sleep mode when the time period for which the stand-by mode is maintained is exceeded or the battery voltage is less than a preset voltage after entering to the stand-by mode; and activating only some of components of each of the communication device and the output device and deactivating a rest of components thereof when entered to the stand-by mode, wherein, the some of components of the output device is controlled by a main processor and the rest of components of the output device is controlled by an auxiliary processor, and during the stand-by mode, the some of components of the output device is controlled to be activated by the main processor and the rest of components of the output device is controlled to be deactivated by the auxiliary processor.

10. The method of claim 9, wherein the stand-by mode is maintained when the battery voltage is higher than the preset voltage, and the time period for which the stand-by mode is maintained is not exceeded.

11. The method of claim 9, further comprising:

deactivating all the components of each of the communication device and the output device when entered to the sleep mode;

activating all the components of each of the communication device and the output device when entered to a normal mode; and entering to the normal mode when use of at least one device among a communication device, an operation device or an output device by a user is detected in the stand-by mode or the sleep mode.

* * * * *